US007576722B2

(12) United States Patent
Tseng

(10) Patent No.: US 7,576,722 B2
(45) Date of Patent: Aug. 18, 2009

(54) GRAY-SCALE METHOD FOR A FLAT PANEL DISPLAY

(75) Inventor: Der-Yuan Tseng, Taoyuan County (TW)

(73) Assignee: Novatek Microelectronics Corp., Hsinchu (TW)

( * ) Notice: Subject to any disclaimer, the term of this patent is extended or adjusted under 35 U.S.C. 154(b) by 672 days.

(21) Appl. No.: 11/306,373

(22) Filed: Dec. 26, 2005

(65) Prior Publication Data

US 2007/0085791 A1 Apr. 19, 2007

(30) Foreign Application Priority Data

Oct. 13, 2005 (TW) ..... 94135661 A

(51) Int. Cl.
*G09G 3/36* (2006.01)
*G09G 5/10* (2006.01)

(52) U.S. Cl. ..... 345/89; 345/690

(58) Field of Classification Search ..... 345/89, 345/690–696

See application file for complete search history.

(56) References Cited

U.S. PATENT DOCUMENTS

2001/0022565 A1* 9/2001 Kimura ..... 345/82
2006/0077140 A1* 4/2006 Kwon ..... 345/77

* cited by examiner

*Primary Examiner*—Amr Awad
*Assistant Examiner*—Jonathan Boyd
(74) *Attorney, Agent, or Firm*—Jianq Chyun IP Office

(57) ABSTRACT

A gray-scale method for a flat panel display is provided, which includes the following: A plurality of scan-line initial signals are provided during a frame period. The scan-line initial signals are transmitted sequentially. According to the scan-line initial signals, the scan-lines are scanned. In which, the frame period includes X horizontal periods. And each horizontal period includes Y initial periods. X and Y each is a positive integer. The scan-line initial signal Kij is appeared during the $j^{th}$ initial period of the $i^{th}$ horizontal period. In which, the i and j at one to one correspondence. The i and j each is a positive integer where $1 \leqq i \leqq X$ and $1 \leqq j \leqq Y$.

2 Claims, 5 Drawing Sheets

GRAY-SCALE METHOD FOR A FLAT PANEL DISPLAY

CROSS-REFERENCE TO RELATED APPLICATION

This application claims the priority benefit of Taiwan application serial no. 94135661, filed on Oct. 13, 2005. All disclosure of the Taiwan application is incorporated herein by reference.

BACKGROUND OF THE INVENTION

1. Field of Invention

The present invention relates to a gray-scale method. More particularly, the present invention relates to a gray-scale method for a flat panel display.

2. Description of Related Art

The traditional gray-scale methods used for a flat panel display include area ratio gray-scale (ARG) and time ratio gray-scale (TRG). The principle of the area ratio gray-scale is to generate different human visual perceptions regarding brightness by the use of a plurality of combinations of usage area. If it is intended to generate a N-bit gray-scale effect, $2^N$ pixels are needed in the intended area. The human visual perception for the gray-scale effect is generated by the use of the ratio of the bright pixels and the dark pixels in the $2^N$ pixels. FIG. 1 is a pixel diagram for generating a plurality of 2-bit gray-scale pixels by the use of area ratio gray-scale. The methods for combining the pixels 110~140 represent a collection of four different gray-scale combinations 150, respectively, in which each gray-scale combination includes four sub-pixels. Regarding the first area ratio pixel combination 110, it includes four fully turned-on (fully-lit) sub-pixels 112~118, and the gray-scale level for which is the brightest as shown by the gray-scale effect 115. The second pixel combination 120 includes a turned-off (dark) sub-pixel, which the result is as shown by the gray-scale effect 125 by which the color is obviously deeper than the gray-scale effect 115. The gray-scale effect 135 is formed by the third pixel combination 130 in which the ratio of the on and off pixels is 1 to 1, and the color of the gray-scale effect 135 is deeper than the color of the gray-scale effect 125. The gray-scale effect 145 is formed by the fourth pixel combination 140, and of which has the darkest color. Because the area ratio gray-scale requires $2^N$ pixels for forming the N-bit gray scale, its resolution is greatly decreased and its gray-scale effect is not able to be easily improved to a higher-bit gray scale effect. Therefore, it is not a gray-scale method suitable for a high-performance display.

Another time ratio gray-scale is intended for achieving the N-bit gray-scale effect by dividing a frame period into $2^N$ sub-frame periods. Since human visual perception has a sensory integration effect, the eyes are able to feel the gray-scale effect as long as the on/off times of the pixels are controlled during a frame period. FIG. 2 is a pixel diagram of a 2-bit time ratio gray-scale displaying method. The sub-frame periods F1~F4 are combined to form a complete frame period F. By controlling the on/off of the pixels during an individual sub-frame period, the pixels are able to achieve the gray-scale effect during a complete frame period F. The first time ratio gray-scale combination 210 is fully-on (fully-lit) to form the gray-scale effect 215, while three time ratio gray-scale combinations 220~240 form the gray-scale effects 225~245, respectively. The luminosity intensity differences between the fully-lit and dark gray-scale effects are evident from FIG. 2. FIG. 3 is a timing diagram of a plurality of sub-frame period of the time ratio gray-scale. A gate driver generates a first initial pulse 310 at a first scan line G1. The first initial pulse 310 occupies a horizontal period. Then, a gate pulse is transmitted to the next scan line G2, G3 . . . GN sequentially via a shift register during each horizontal period. The first initial pulse 310 enables the pixels on the display panel sequentially. A source driver is used for outputting the required display data D1~DN to the pixels on each scan line. By controlling the first initial pulse 310 within each sub-frame period during the timing 300, the combinations of the sub-frames F1~F4 as shown in FIG. 2 can be achieved and the desired gray-scale frame combination is formed. However, the time length of the sub-frame period in the time ratio gray-scale must be $1/2^N$ times of that of a complete frame period. In other words, it is required to increase the working frequency of the peripheral circuits of a display by $2^N$ times. Therefore, the circuit complexity, power consumption rate, and the heat dissipation problems are increased significantly.

Most of the current liquid crystal displays adopt the above two gray-scale methods, or a combination of the two above methods for achieving a higher resolution. However, the decrease of the resolution and the increase of the working frequency for the circuit still cannot be solved at the same time.

SUMMARY OF THE INVENTION

Accordingly, the present invention is directed for providing a gray-scale method for a flat panel display. It is accomplished by generating a plurality of scan-line initial signals and reducing the pulse width of the scan-line initial signals such that there is a period of delay time between two adjacent scan-line initial signals. During a frame period, the relative locations of each scan-line initial signal during its corresponding horizontal period are made to be different. The advantage is that, the gray-scale effect is achieved without increasing the working frequency for the circuit and decreasing the display resolution. And the complexity, power consumption rate and heat dissipation problem of circuits can be reduced as well.

To achieve the above and other objectives, the present invention provides a gray-scale method for a flat panel display, which includes the following steps: Firstly, providing a plurality of scan-line initial signals during a frame period. If the gray-scale is N-bit, $2^N$ scan-line initial signals are provided, so that each pixel in a display can be enabled for $2^N$ times during each frame period. Different display signals are inputted for achieving the desired N-bit gray-scale effect each time the pixels are enabled. Next, the scan-line initial signals are transmitted sequentially according to a specific delay time. During a frame period, each scan-line initial signal shall be transmitted from the first scan line to the last scan line sequentially. At the same time, a plurality of scan lines are started to be scanned according to the scan-line initial signals. Then the gates on the display are opened sequentially by the scan-line initial signals, such that the desired display signals can be inputted to the pixels by the source driving signals. In which, each frame period includes X horizontal periods. Each horizontal period includes Y initial periods. The X and Y are each a positive integer. In other words, each frame period includes X horizontal periods. Each horizontal period includes Y initial periods. A scan-line initial signal Kij is appeared during the $j^{th}$ initial period of the $i^{th}$ horizontal period, in which i and j are at one to one. The i and j are each a positive integer, in which $1 \leqq i \leqq X$ and $1 \leqq j \leqq Y$. In other words, for every scan line, the scan-line initial signals that are appeared during a frame period are in different initial periods of the different horizontal periods, and the scan-line initial signals on different scan lines shall not appear at the same time.

In one embodiment of the above-mentioned gray-scale method for a flat panel display in which the display has a N-bit gray-scale resolution, it is required to provide $2^N$ scan-line initial signals.

In one embodiment of the above-mentioned gray-scale method for a flat panel display, the pulse width of each scan-line initial signal is equal to or smaller than $(Ts/2^N)$, where Ts is the time length of the horizontal period, so as to avoid the overlapping of the scan-line initial signals on different scan lines due to a pulse width which is oversized, and to avoid the simultaneous enabling of different scan lines during the same period.

In one embodiment of the above-mentioned gray-scale method for a flat panel display, the time length of a time space between two adjacent scan-line initial signals or also known as the delay time is $(Tf/2^N)+(Ts/2^N)$, in which, Tf is the time of a frame, and Ts is the time length of the horizontal period. The aforementioned delay time is used for avoiding the simultaneous occurrence of all of the scan-line initial signals when they are transmitted sequentially.

In the present invention, because of the use of the method for reducing the pulse width of the scan lines and of the control of the delay time, under a lower working frequency of the peripheral circuits of a display, the same gray-scale effect and resolution can be achieved, and the circuit complexity, power consumption rate, and the heat dissipation problem of circuits are reduced as well.

To make the aforementioned and other objectives, features, and advantages of the present invention comprehensible, an embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included for providing a further understanding of the invention, and are incorporated in and constitute a part of this specification. The drawings illustrate the embodiments of the invention and, together with the description, serve to explain the principles of the invention.

DESCRIPTION OF EMBODIMENTS

Figure 1:
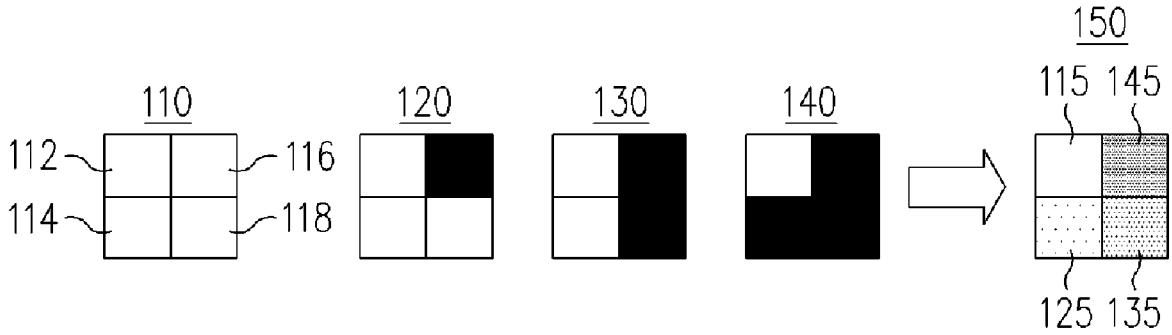
FIG. 1 (PRIOR ART)
FIG. 1 depicts a schematic diagram of a conventional method for generating 2-bit gray-scale pixels by using the area ratio gray-scale.
Figure 2:
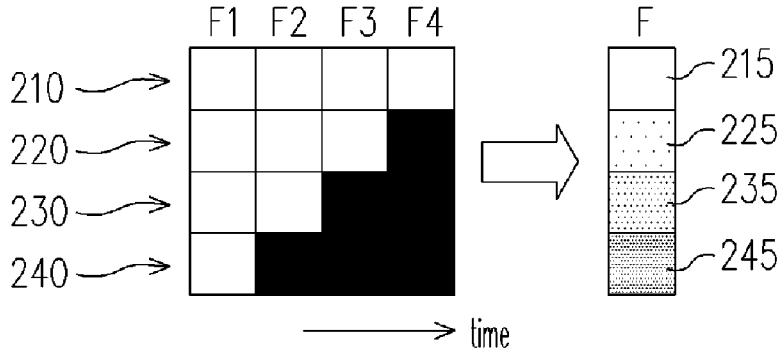
FIG. 2 (PRIOR ART)
FIG. 2 depicts a schematic diagram of a conventional displaying method using a 2-bit time ratio gray-scale.
Figure 3:
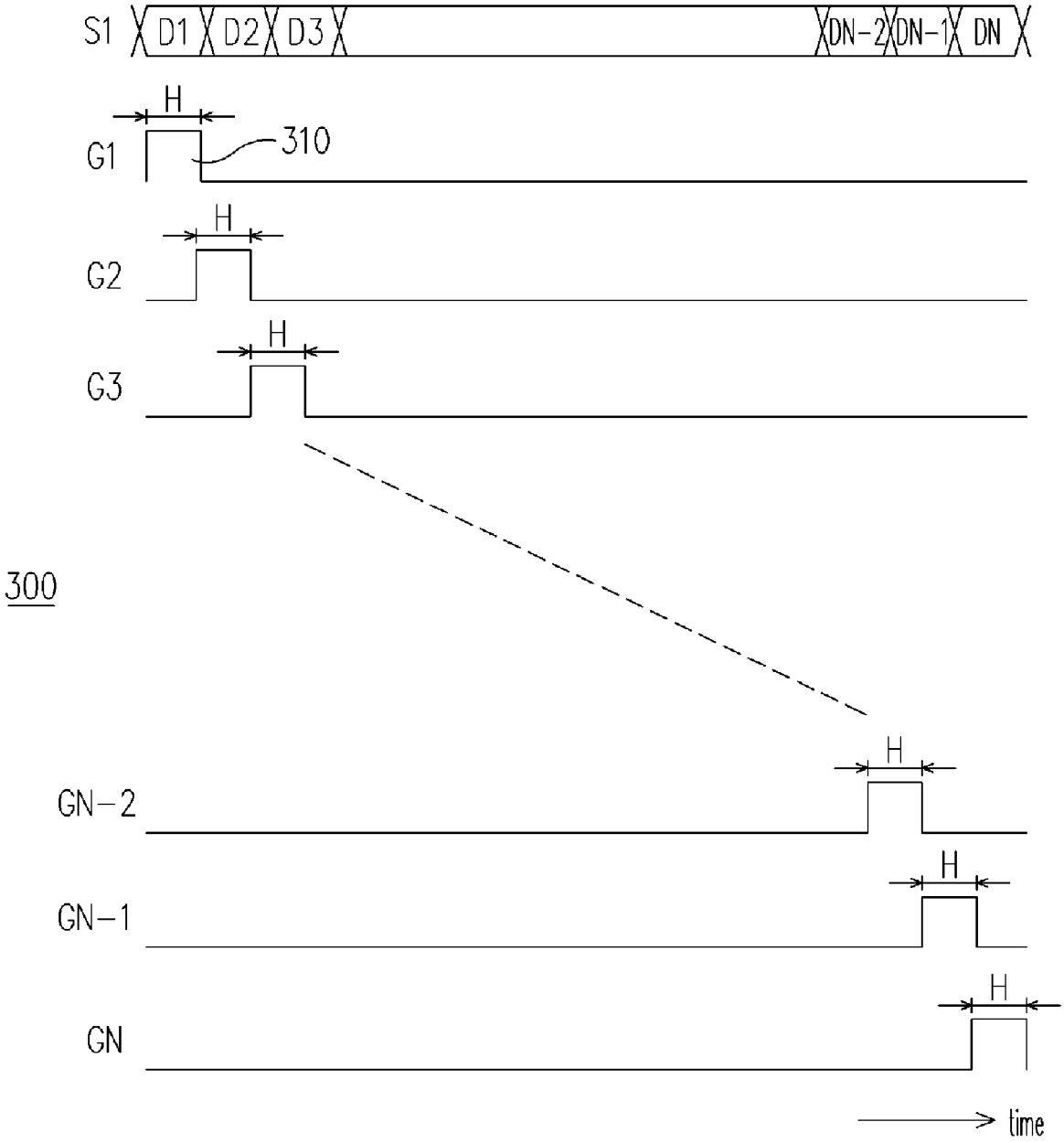
FIG. 3 (PRIOR ART)
FIG. 3 depicts a timing diagram of the time ratio gray-scale sub-frame time found in conventional technology.

A specific embodiment of the present invention is provided and illustrated in details as follows in combination with appended drawings. The same or similar element numerals represent elements with the same or similar functions whether they are in the drawings or the descriptions herein, unless it is otherwise illustrated.

Figure 4:
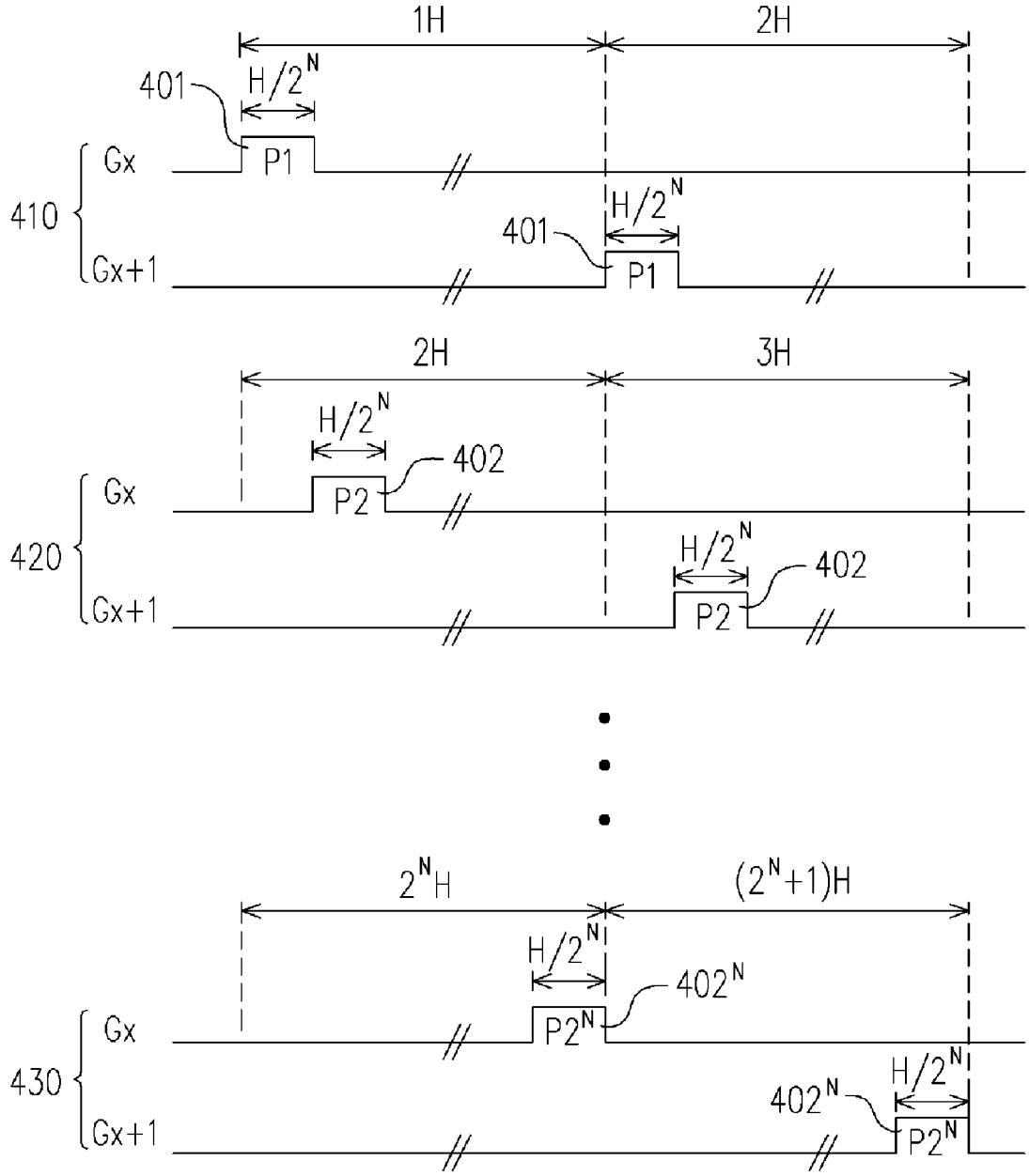
FIG. 4 depicts a timing diagram of the scan-line initial signals according to an embodiment of the present invention.

Referring to FIG. 4 in the following illustration, it is a timing diagram of the scan-line initial signals of a gray-scale method for a flat panel display according to one embodiment of the present invention. The FIG. 4 mainly illustrates the timing variations of the scan-line initial signals 401~402$^N$ on two adjacent scan lines and the timing relationship of the scanning signals on a same scan line. In the timing diagram of a N-bit gray scale in the aforementioned embodiment, each of the scan-line initial signals 401~402$^N$ is a pulse signal, with a width of $H/2^N$, which is the same as an individual width of the initial periods P1~P2$^N$. H is the time length of a horizontal period. P1~P2$^N$ represent the 1~$2^{Nth}$ initial periods. The time length H of a horizontal diagram of the $x^{th}$ scan line, and Gx+1 represents the timing diagram of the $x+1^{th}$ scan line, where x is a positive integer. 1H~$(2^N+1)$ H represents the 1~$(2^N+1)^{th}$ horizontal period. As shown in the timing 410 of the 1st horizontal period, the $1^{st}$ scan-line initial signal 401 is appeared on the timing Gx of the $x^{th}$ scan line, and the period of its appearance is the $1^{st}$ initial period P1 of the $1^{st}$ horizontal period 1H. After a delay of a time length H of a horizontal period, the aforementioned $1^{st}$ scan-line initial signal 401 is transmitted to the next scan line, and the period for its appearance is the $1^{st}$ initial period P1 of the $2^{nd}$ horizontal period 2H on the timing Gx+1 of the $x+1^{th}$ scan line. It is then transmitted to the next scan line sequentially.

Next, on the timing 420 of the $2^{nd}$ horizontal period, a scan-line initial signal 402 is appeared during the $2^{nd}$ initial period P2 of the $2^{nd}$ horizontal period 2H on the timing Gx of the $x^{th}$ scan line. After it is transmitted, the aforementioned scan-line initial signal 402 shall appear during the $2^{nd}$ initial period P2 of the $3^{rd}$ horizontal period 3H on the timing Gx+1 of the $x+1^{th}$ scan line. If there is a next available scan line, it is transmitted to the next scan line according to the same delay time. Similarly, the $2^{Nth}$ scan-line initial signal 402$^N$ shall occur during the $2^{Nth}$ initial period P2$^N$ of the $2^{Nth}$ horizontal period 2$^N$ H on the timing Gx. After a delay of the time length H of a horizontal period, the aforementioned scan-line initial signal 402$^N$ shall appear during the $2^{Nth}$ initial period P2$^N$ of the $(2^N+1)^{th}$ horizontal period $(2^N+1)$H on the timing Gx+1 of the $x+1^{th}$ scan line, and it is transmitted to the next scan line sequentially. The signal transmitting method for the other timings shall be easily conceived by those skilled in the art based on the disclosure of the present invention, which shall not be further described.

Figure 5:
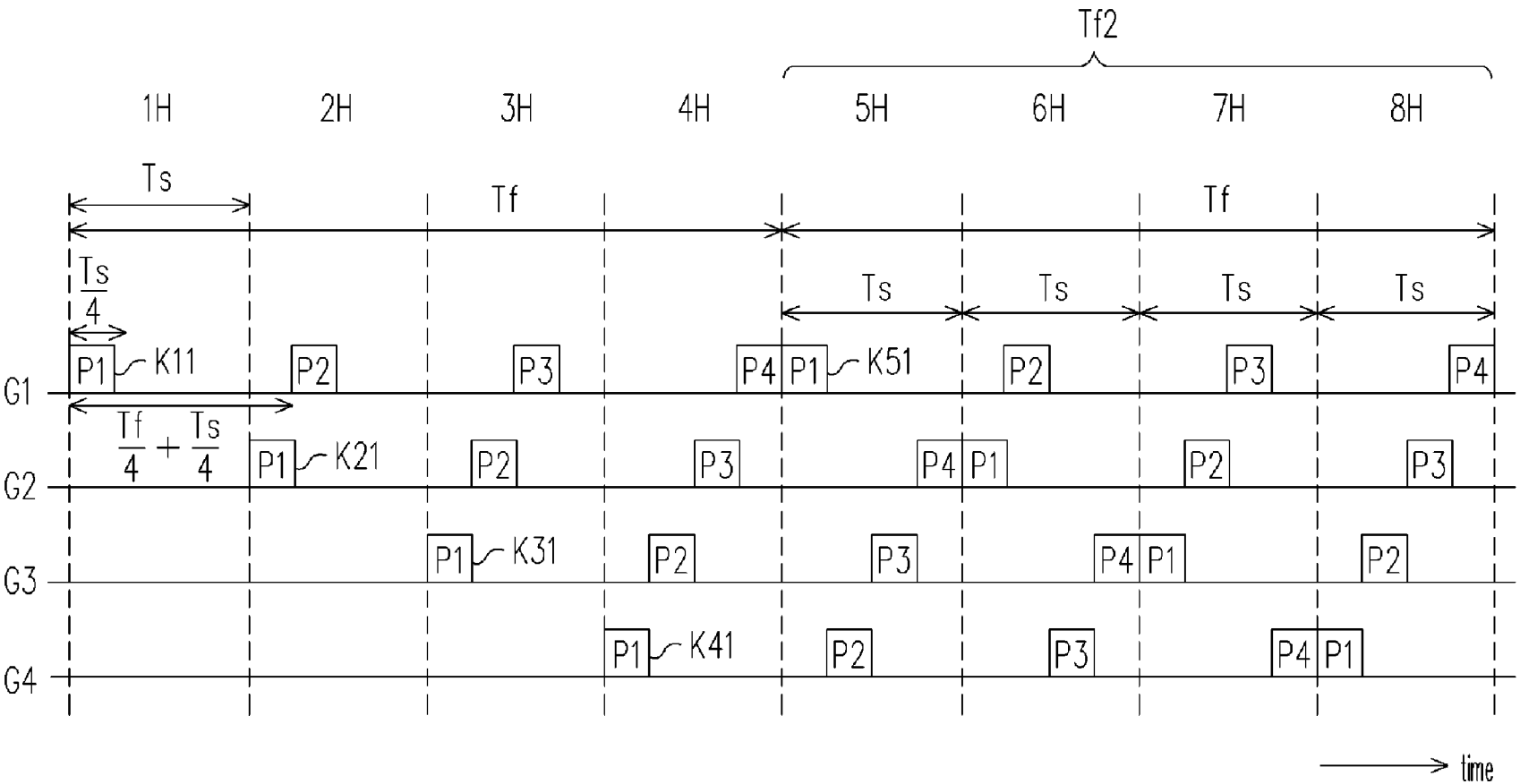
FIG. 5 depicts a timing diagram of a 2-bit gray-scale according to an embodiment of the present invention.

FIG. 5 is a timing diagram of a 2-bit gray scale of the gray-scale method for a flat panel display according to one embodiment of the present invention. The scan-line initial signal in the embodiment is a pulse signal. A time length Tf of the frame period is used as a unit for separating each of the scan-line timing G1~G4. The time length Tf of each frame period includes the time length Ts of 4 horizontal periods. The time length Ts of each horizontal period is divided into 4 initial periods P1~P4, in which each having an initial period of Ts/4. The initial signal pulse appeared during the $j^{th}$ initial period of the $i^{th}$ horizontal period is referred to as Kij. Firstly, a $1^{st}$ initial pulse K11 is appeared during the $1^{st}$ initial period P1 of the $1^{st}$ horizontal period 1H on the timing G1 of the $1^{st}$ scan line, where the pulse width is Ts/4. After each delay time (Tf/4+Ts/4), an initial signal pulse is outputted. After a time length Tf of a frame period, the initial signal pulse again is appeared during the $1^{st}$ initial period of the $1^{st}$ horizontal period in its frame period.

In other words, for example, if the frame period includes a $5^{th}$ horizontal period 5H to an $8^{th}$ horizontal period 8H, a $1^{st}$ initial signal pulse K51 in the frame period is appeared, and the next initial signal pulse is continued to appear according to the delay time (Tf/4+Ts/4). Each initial signal pulse appearing on the timing G1 of the 1$^{st}$ scan line is transmitted to the next scan line sequentially via a shift register each time that a time length Ts of a horizontal period is passed. Therefore, an initial signal pulse K21 shall appear on the timing G2 of the 2$^{nd}$ scan line, and shall be transmitted to the next scan line sequentially. An initial signal pulse K31 shall appear on the timing G3 of the 3$^{rd}$ scan line, and an initial signal pulse K41 shall appear on the timing G4 of the 4$^{th}$ scan line. As shown in FIG. 5, the initial signal pulses appearing on the other timings are each similarly transmitted corresponding to the above-mentioned manner, which shall not be further repeated.

When the timing has entered the 2$^{nd}$ frame period Tf2, it is obvious judging from FIG. 5 that, during the 2$^{nd}$ frame period, each timing (G1~G4) has 4 initial signal pulses, and only one initial signal pulse shall appear at the same time point. In other words, if used in a thin film transistor liquid crystal display, a gate driver is able to input the pulse signals to a thin film transistor gate on the display panel sequentially during the 2$^{nd}$ frame period, and a source driver shall input the required data signal to the pixels to achieve the desired gray-scale effect. The signal variations for the other timings shall have been easily conceived by those skilled in the art based on the above description according to the embodiment of the present invention, which shall not be further described.

Figure 6:
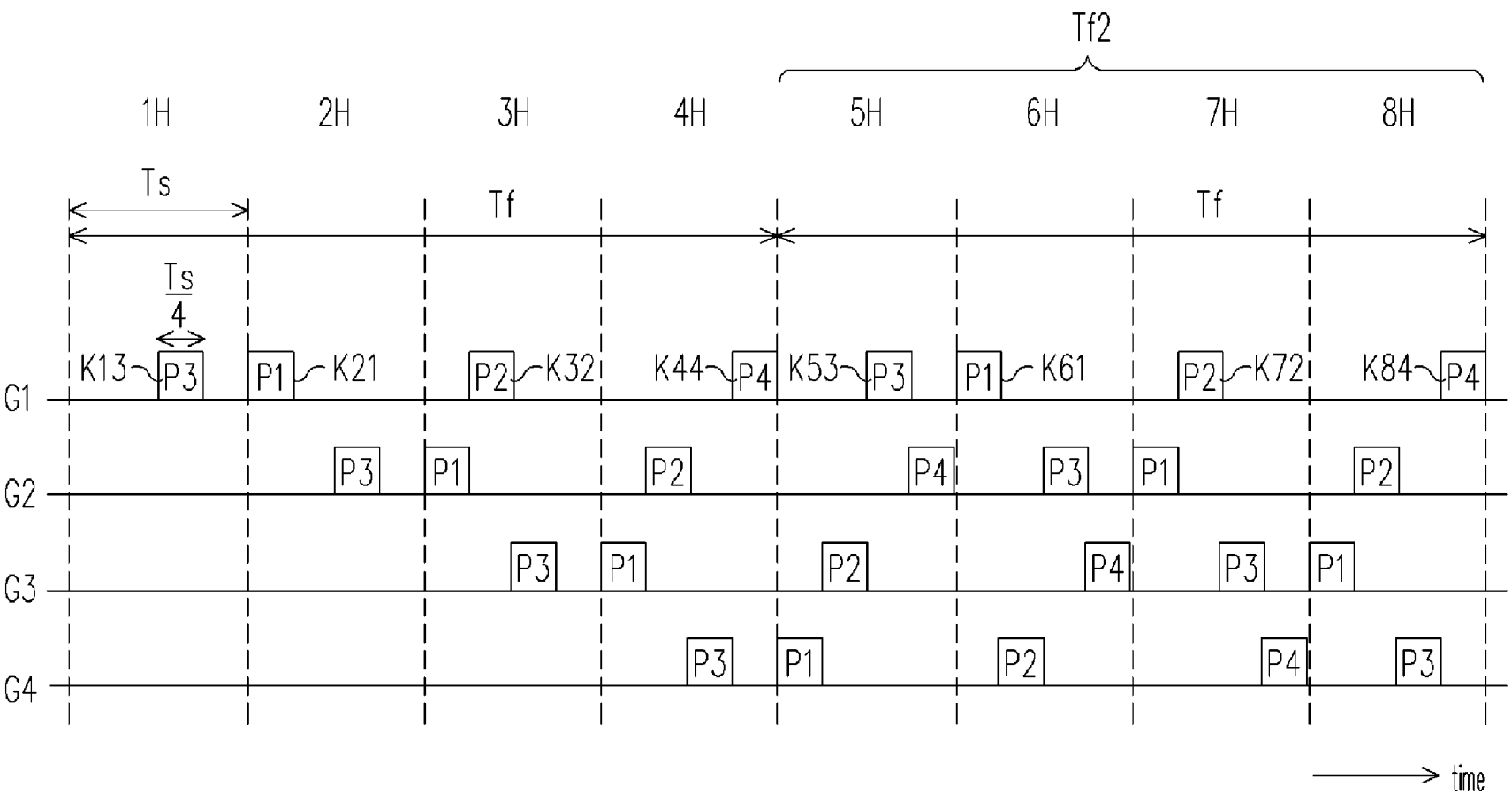
FIG. 6 depicts a gray-scale timing diagram according to an embodiment of the present invention.

FIG. 6 is a timing diagram of the gray-scale method for a flat panel display according to another embodiment of the present invention, which is different from the aforementioned embodiment of FIG. 5 in that, the sequence of appearance and the delay time for the initial signal pulse Kij are different. As shown in FIG. 6, a first initial pulse K13 is first appeared during the 3$^{rd}$ initial period P3 of the first horizontal period 1H on the timing of the first scan line, with a pulse width smaller than or equal to Ts/4. In FIG. 6, it is equaled to Ts/4. The time length Tf of each frame period includes four Ts, and each Ts is the length of a horizontal period. The three initial pulses appearing during the time length Tf of the first frame period are K21, K32, and K44, respectively. Each of the initial signal pulse is transmitted to the next scan line sequentially via a shift register each time a time length Ts of a horizontal period is passed. The manner for transmission is as illustrated in the above embodiment in FIG. 5, which shall not be further repeated.

During each frame period, the relative position of an initial signal pulse appearing on the timing G1 of the first scan line is the same as that in the first frame period. Therefore, the initial signal pulses appearing during the 2$^{nd}$ frame period Tf2 are K53, K61, K72 and K84. Similarly, those skilled in the art shall have easily conceived the timing diagrams during the other frame periods based on the disclosure of the present invention, which shall not be further repeated. Using the 2$^{nd}$ frame period Tf2 in FIG. 6 as an example, the timing G1~G4 for each scan-line has 4 initial signal pulses during the 2$^{nd}$ frame period Tf2, and only one initial signal pulse is appeared at a same time point. As a result, a 2-bit gray-scale resolution can be achieved.

To sum up, the gray-scale method for a flat panel display according to the present invention may extend to X scan-line timings, where X is an integer larger than zero. According to the aforementioned gray-scale method, a frame period is divided into X horizontal periods. Each horizontal period includes Y initial periods, where Y is a positive integer. If it is required to achieve a N-bit gray-scale resolution, $Y=2^N$, where N is a positive integer. Next, a plurality of scan-line initial signals are provided during a frame period. Each scan-line initial signal Kij is appeared during the j$^{th}$ initial period of the i$^{th}$ horizontal period, in which i and j are one to one. The i and j is each a positive integer and $1 \leqq i \leqq X$, $1 \leqq j \leqq Y$. In other words, only one scan-line initial signal is appeared on any one scan line during each horizontal period of each frame period, and it is corresponded to the initial period in which a scan-line initial signal has appeared. During the other remaining similar initial periods of the same frame period, the scan-line initial signal shall not appear again.

Then, the scan-line initial signal is transmitted to the next scan line sequentially, and its delay time length is the time length for one horizontal period. The corresponding scan line is then scanned according to the scan-line initial signal. According to the number of times of repeatedly scanning the same scan line by the scan-line initial signal during the same frame period, and the pixels of the corresponding data signals for display panel that are inputted by the source driver, a N-bit gray-scale resolution can be achieved.

From the above descriptions, the gray-scale method of the present invention may provide a new solution according to the gray-scale method for a flat panel display. By adopting the control of the manner for the signal-transmission used for achieving the gray-scale effect, the working frequency of the peripheral circuits, complexity, and the power consumption rate of the circuit can be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A gray-scale method for a flat panel display, comprising: providing a plurality of scan-line initial signals during a frame period; transmitting the scan-line initial signals sequentially; and scanning a plurality of scan lines according to the scan-line initial signals, wherein the frame period includes X horizontal periods, and each of the horizontal periods includes Y initial periods, wherein X and Y each is a positive integer;

making any one of the scan-line initial signal Kij to appear during the jth initial period of the i$^{th}$ horizontal period, in which the i and j are one to one, and the i and j each is a positive integer, and $1 \leqq I \leqq X$, $1 \leqq j \leqq Y$; and wherein providing the scan-line initial signals during the frame period comprises of providing $2^N$ scan-line initial signals when a N-bit gray-scale resolution is required wherein a time length of a time space between the start of one of two adjacent scan-line initial signals and the start of the other one of said two adjacent scan-line initial signals is $(Tf/2^N)+(Ts/2^N)$, wherein Tf is the time of a frame, and Ts is the time length of the horizontal period.

2. The gray-scale method for a flat panel display as recited in claim 1, wherein the pulse width of each of the scan-line initial signals is equal to or less than $(Ts/2^N)$, wherein, Ts is a time length of the horizontal period.

* * * * *